US011369830B2

(12) United States Patent
Schmidt

(10) Patent No.: US 11,369,830 B2
(45) Date of Patent: Jun. 28, 2022

(54) BODY TETHER APPARATUS

(71) Applicant: Schmidt Design, LLC, Darien, CT (US)

(72) Inventor: David Schmidt, Darien, CT (US)

(73) Assignee: Schmidt Design, LLC, Darien, CT (US)

( * ) Notice: Subject to any disclaimer, the term of this patent is extended or adjusted under 35 U.S.C. 154(b) by 336 days.

(21) Appl. No.: 16/169,171

(22) Filed: Oct. 24, 2018

(65) Prior Publication Data

US 2019/0126089 A1 May 2, 2019

Related U.S. Application Data

(60) Provisional application No. 62/577,190, filed on Oct. 26, 2017.

(51) Int. Cl.

| | |
|---|---|
| ***A63B 21/00*** | (2006.01) |
| ***A63B 21/005*** | (2006.01) |
| ***A63B 21/16*** | (2006.01) |
| ***A63B 23/04*** | (2006.01) |
| ***A63B 24/00*** | (2006.01) |

(Continued)

(52) U.S. Cl.

CPC ..... *A63B 21/154* (2013.01); *A63B 21/0058* (2013.01); *A63B 21/153* (2013.01); *A63B 21/157* (2013.01); *A63B 21/16* (2013.01); *A63B 23/047* (2013.01); *A63B 24/0087* (2013.01); *A63B 71/0054* (2013.01); *A63B 71/02* (2013.01); *A63B 21/169* (2015.10); *A63B 71/0619* (2013.01); *A63B 2024/0093* (2013.01); *A63B 2071/0072* (2013.01); *A63B 2208/0204* (2013.01); *A63B 2220/20* (2013.01); *A63B 2220/51* (2013.01); *A63B 2220/58* (2013.01); *A63B 2225/093* (2013.01); *A63B 2225/50* (2013.01)

(58) Field of Classification Search

CPC . A63B 21/154; A63B 21/157; A63B 24/0087; A63B 23/047; A63B 71/0054; A63B 71/02; A63B 21/16; A63B 21/153; A63B 21/0058; A63B 71/0619; A63B 21/169; A63B 2225/50; A63B 2225/093; A63B 2220/58; A63B 2071/0072; A63B 2024/0093; A63B 2220/20; A63B 2208/0204; A63B 2220/51; A63B 2220/00; A63B 2220/10; A63B 2220/13; A63B 2220/16; A63B 2220/24; A63B 2220/30–35; A63B 2220/50–51; A63B 2220/72; A63B 2220/803; A63B 2220/833; A63B 21/0059

See application file for complete search history.

(56) References Cited

U.S. PATENT DOCUMENTS

| | | | |
|---|---|---|---|
| 5,167,601 | A | 12/1992 | Frappier |
| 8,088,045 | B2 | 1/2012 | Hoffman |

(Continued)

*Primary Examiner* — Joshua Lee
*Assistant Examiner* — Catrina A Letterman

(57) ABSTRACT

An exercise device consisting of a housing having a rope extending therethrough and wherein the rope is wound about a spool mounted on a driveshaft driven in a forward direction by a motor. The spool includes a one-way clutch for engaging the driveshaft in the forward direction and freely rotating on the driveshaft in the reverse direction. A recoil mechanism is coupled to the spool to rotate the spool in the reverse direction and rewind the rope.

6 Claims, 5 Drawing Sheets

(51) Int. Cl.

| | |
|---|---|
| ***A63B 71/02*** | (2006.01) |
| ***A63B 71/00*** | (2006.01) |
| *A63B 71/06* | (2006.01) |

(56) References Cited

U.S. PATENT DOCUMENTS

| | | | | |
|---|---|---|---|---|
| 8,333,681 | B2 | 12/2012 | Schmidt | |
| 9,539,458 | B1 | 1/2017 | Ross | |
| 9,694,225 | B2 | 7/2017 | Toback et al. | |
| 9,724,563 | B2 | 8/2017 | Schmidt | |
| 10,143,880 | B1 * | 12/2018 | Boatwright | A63B 21/075 |
| 10,376,732 | B2 * | 8/2019 | Garsdean | A63B 21/4035 |
| 2006/0199711 | A1 | 9/2006 | Miers | |
| 2013/0015284 | A1 * | 1/2013 | Tracey | B65H 75/4484 242/390.2 |
| 2013/0267384 | A1 * | 10/2013 | Eldridge | A63B 21/0058 482/5 |
| 2014/0038777 | A1 * | 2/2014 | Bird | A63B 21/151 482/5 |
| 2016/0354638 | A1 * | 12/2016 | Carr | A63B 24/0087 |
| 2018/0214729 | A1 * | 8/2018 | Rubin | A63B 21/0058 |
| 2019/0099652 | A1 * | 4/2019 | Orady | A63B 23/12 |

* cited by examiner

BODY TETHER APPARATUS

CROSS-REFERENCE TO RELATED APPLICATION

This application claims the benefit of U.S. Provisional Patent Application No. 62/577,190 filed Oct. 26, 2017, which is hereby incorporated by reference in its entirety herein.

BACKGROUND OF THE INVENTION

I. Field of the Invention

The present disclosure relates generally to a device for use with rehabilitation, sports training and fitness, and more specifically to a resisted walking/running/pushing/pulling body tether exercise apparatus.

II. Description of the Prior Art

Typical exercise equipment works the heart and lungs together with various muscle groups to allegedly improve a user's endurance and strength. The devices typically require the user to run, jog, walk, bike, climb and the like for a prolonged period of time to build up the lungs and heart, as well as to promote muscle health. Examples of such equipment includes weights, treadmills, elliptical machines, exercise bikes, steppers and the like.

Running/walking is the one exercise that the human body is most evolved to suit. Various devices are known to permit a person to simulate a run. Such devices include the aforementioned treadmills, both self-powered and electrically powered, as well as stepper platforms, etc. In addition, one can attach one end of an elastic cord to a stationary frame or doorway and wrap the other end around the person's torso to provide resistance while leaning forward and running in place.

One example of a device to be mounted to a doorway is shown in the prior art illustration of FIG. 1. In particular, the running restraint device 10 is adapted to be mounted or fastened to a stationary object such as a stationary frame, a doorway 12, door, wall, ceiling, or other stationary structure. The device has a generally rigid pad 14 to be placed against and in front of a user's pelvis and abdominal area 16. A pair of cords 18 is attached to the pad 14, each having an opposite end attached to an elastic member 20 through an anchor 22. The device 10 is removably fastened to the stationary object, e.g. a door 24, a doorway frame 12, or sandwiched between a closed door and the doorway frame. A user, for example, fastens the apparatus in place in the doorway, faces away from the doorway, and places the pad against his torso directly over his pelvis area, and then runs in a direction away from the doorway. The elastic members resist and restrain the user from the substantial movement away from the doorway but stretch to allow some limited forward running movement.

Another example of a device to provide stationary resistance for a runner is shown in the prior art illustration of FIG. 2. In particular, the running training device 26 is shown attached to each leg of runner 28 by means of a set of leg bindings comprising thigh bindings 30 and calf bindings 32 coupled together via a connector member 34. Each connector is attached to either end of an elongated elastomeric and stretchable cord 36. The cord can then be attached to a stationary support means or alternatively, a person, such as a trainer 38, grasping the extending lengths of the cord 36.

Both conventional treadmill type exercise machines as well as the aforementioned strap-type restraint devices have their disadvantages. For example, a treadmill tends to unnerve people due to its moving floor and more often than not leads itself to boredom while the restraint devices are difficult to adjust and fit. Whether using a treadmill or the current prior art restraint devices, the user is unable to utilize their natural running gait under real world terrain.

Additionally, current motorized resisted walking/running devices typically use a single motor for both payout and retraction of the rope (flexible element). Generally, these devices use a transmission with sufficient mechanical reduction to enable the motor to supply ample resistance to the user. These systems may work for long, uninterrupted runs, but certainly suffer in performance during rapid starts and stops as the inertia of the device motor causes delays in change of direction resulting in slack in the rope as well as a jerky feeling to the user. This becomes particularly bothersome when the user stands in a stationary position and uses the device for short, repeated pulls, such as when doing a rowing exercise.

The present disclosure overcomes the problems associated with conventional treadmill type exercise machines, strap-type restraint devices and resisted walking/running devices by utilizing a tether exercise apparatus. Accordingly, it is a general object of this disclosure to provide a motorized tether exercise machine.

It is another general object of the present disclosure to provide a motorized tether exercise machine that enables the user to move with his natural gait under real world terrain.

It is a more specific object of the present disclosure to provide a motorized body tether exercise machine that enables user rapid starts and stops.

It is another more specific object of the present disclosure to provide a motorized tether exercise machine that includes one or more safety mechanisms to protect the user and machine.

Yet another object of the present disclosure is to provide a portable motorized tether exercise machine.

Still another object of the present disclosure is to provide a motorized body tether exercise machine that enables data measurement and associated performance display.

These and other objects, features and advantages of this disclosure will be clearly understood through a consideration of the following detailed description.

SUMMARY OF THE INVENTION

According to an embodiment of the present disclosure, there is provided an exercise apparatus having a rope wound around a spool mounted on a motor driven driveshaft for rotation in a user engageable forward direction. The spool includes a one-way clutch for engaging the driveshaft in the forward direction. A recoil mechanism is coupled to the spool for rotation of the spool in a backward direction.

According to another embodiment of the present disclosure, there is provided a resisted tether exercise machine having a housing containing a rope wound around a spool and an opening for the user engageable end to exit. The machine includes a support arm pivotally attached to a base whereby when the arm is in a first position the base is affixed to a vertical support surface and when the arm is in a second position the base is supported on a horizontal surface and anchored to a fixed point. A pulley is affixed to the arm to direct the rope to a user.

BRIEF DESCRIPTION OF THE DRAWINGS

The present disclosure will be more fully understood by reference to the following detailed description of one or more preferred embodiments when read in conjunction with the accompanying drawings, in which like reference characters refer to like parts throughout the views and in which.

DESCRIPTION OF THE PREFERRED EMBODIMENTS

One or more embodiments of the subject disclosure will now be described with the aid of numerous drawings. Unless otherwise indicated, use of specific terms will be understood to include multiple versions and forms thereof.

Figure 1:
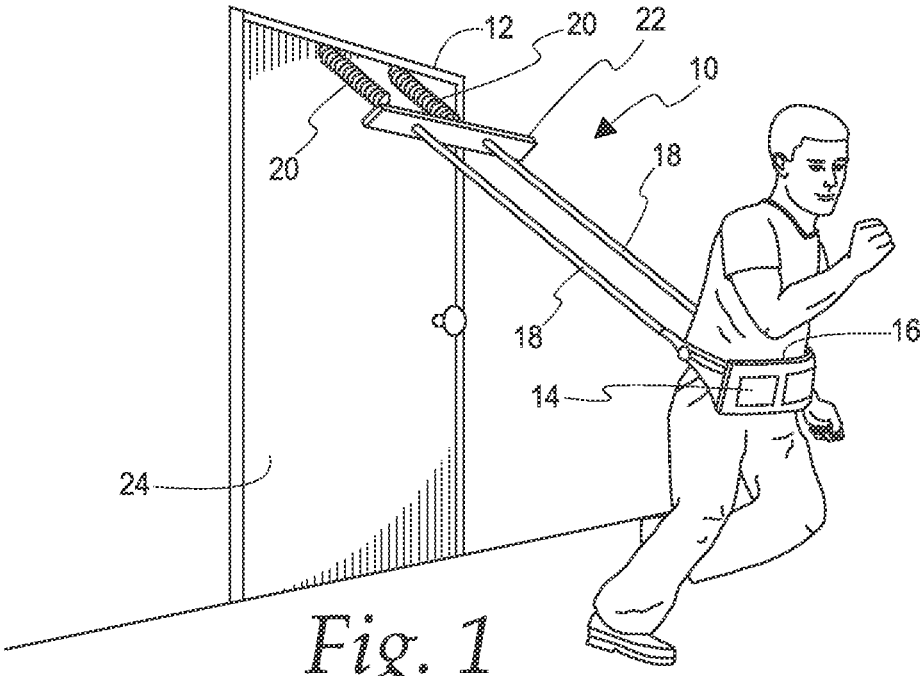
Fig. 1 (PRIOR ART)
FIG. 1 is a perspective view of a prior art runner restraint exercise system being used by a person running in place.
Figure 2:
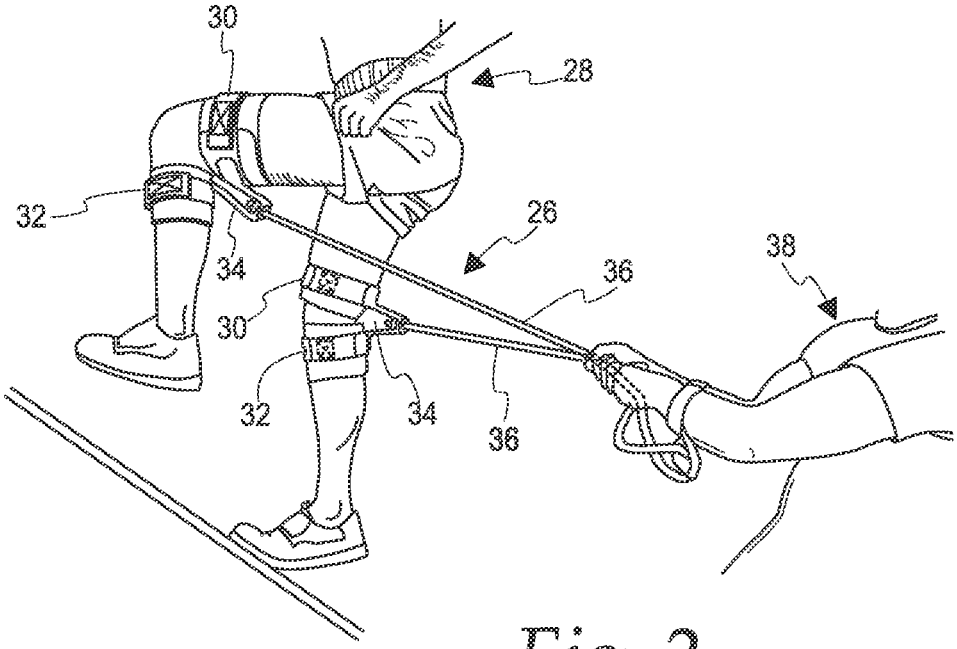
Fig. 2 (PRIOR ART)
FIG. 2 is a side perspective view of another prior art training device in position on an athlete for training.
Figure 3:
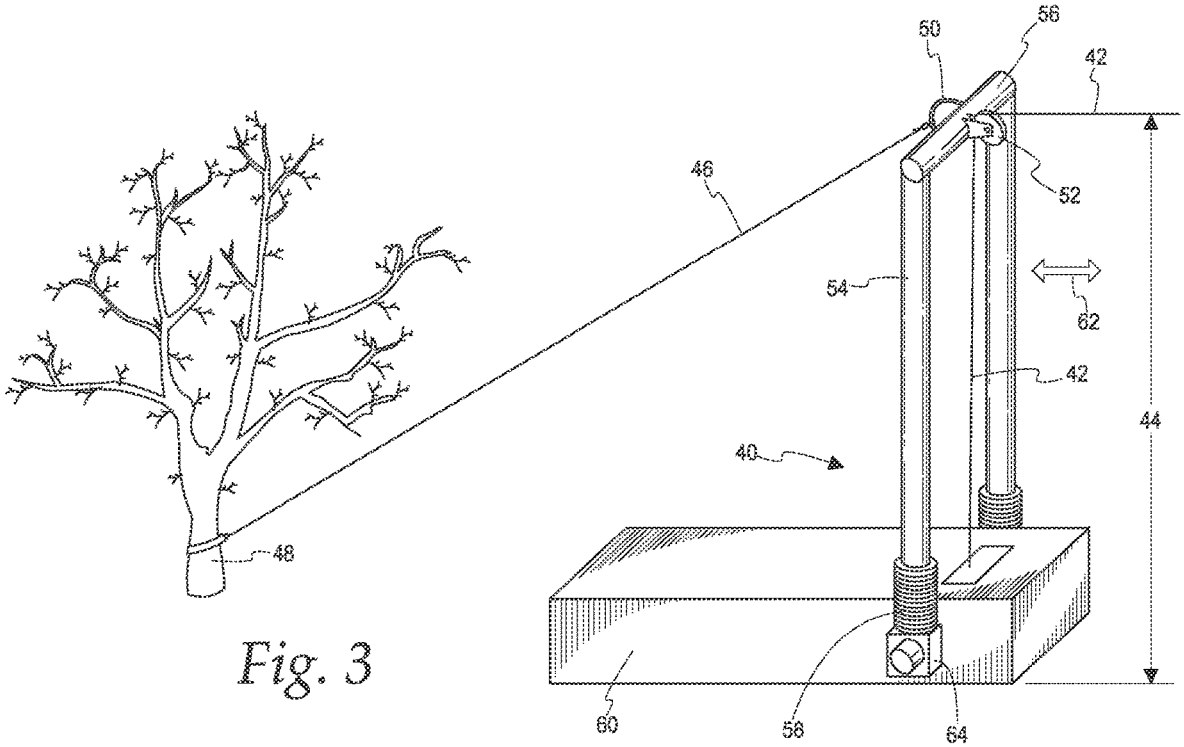
FIG. 3 is a perspective view of a motorized tether exercise machine according to the principles of an embodiment of the present disclosure shown anchored to a tree.
Figure 4:
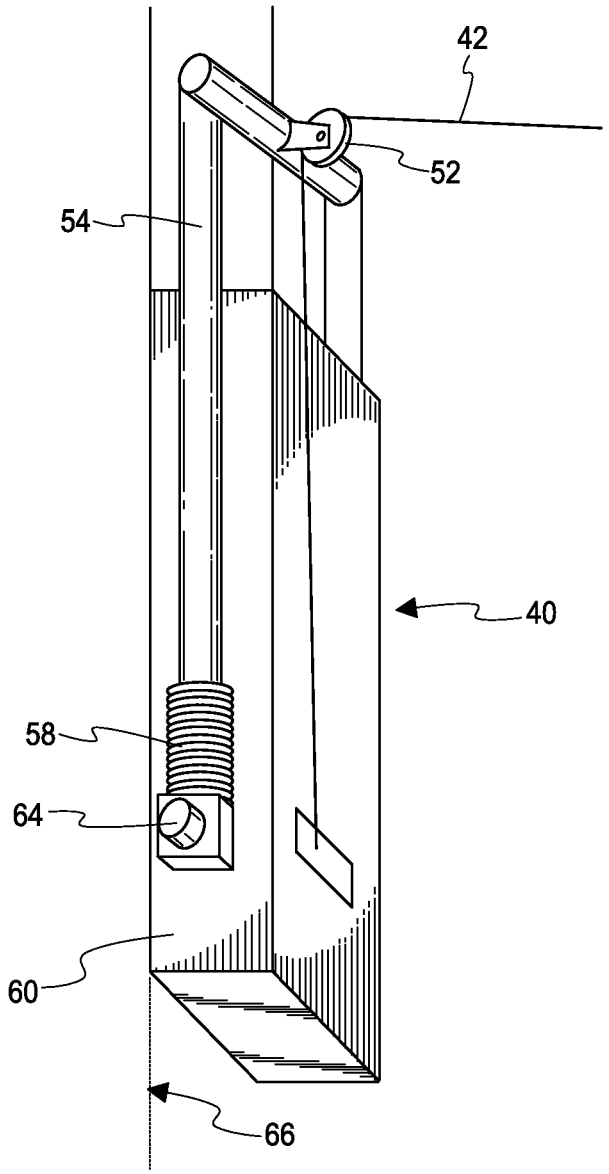
FIG. 4 is a perspective view of a motorized tether exercise machine of the machine of FIG. 3 shown in a position to be wall mounted/anchored.

Turning now to FIGS. 3 and 4, and first to FIG. 3, the resisted walking/running device or tether exercise apparatus 40 includes a housing that is designed to be portable so that it can be used outdoors. In this embodiment it may be desirable to have the opening or exit point for the user engageable end of a flexible element (e.g. rope, cable, line or the like) 42 at some distance (i.e. three feet) 44 off of the ground or other horizontal support surface to ensure a proper lead when attaching to a belt. In order to properly anchor the apparatus 40 so that it is not dragged by the user, a tether 46 can be employed which anchors/ties the apparatus to a fixed point 48 (e.g. tree, fence or stake in the ground). The tether 46 attachment or anchor point 50 on the machine should be in the approximate area of the flexible element guide or exit pulley 52, otherwise the machine may be pulled over during use.

The apparatus 40 includes one or more adjustable vertical supports (e.g. arms) 54 extending upwards whereby the exit pulley 52 or the like is attached to the top end 56. The support 54 is pivotally mounted, preferably with a spring 58 or the like at the base 60. As the user walks/runs/pulls on the flexible element, it is anticipated that the force applied will vary. For example, a user walking will apply greatest force when pushing off with one foot, and the least force when landing on the opposite foot. The tether will generally have a slight amount of sag which will change from high force application to low force application. As a result, the support arm 54 will tend to move 62 slightly forward and backward in response to the user's variable force application. While FIG. 3 illustrates a locking pivot mechanism 64 keeping the support 54 generally perpendicular to the base 60, it is the springs 58 that allow the arms 54 to move independently of the machine 40 base 60 thereby eliminating rocking which would otherwise be present.

Accordingly, the feeder pulley 52 is mounted on arms 54 which are rotatably mounted to the base 60 of the machine 40. When used outdoors, or in a situation where a permanent mount is not practical, the arms are extended and locked 64 in a first position (FIG. 3) to allow the base unit to sit flat on the ground. The arms are then fastened to a tether 46 or other holding mechanism which is then secured to a stationary object such as a tree 48 or fence post. When it is desirable to mount the unit 40 to a fixed spot such as a wall or other vertical support surface 66 the arms fold down and locked 64 to a second position (FIG. 4) allowing the unit 40 to be affixed via a bracket or otherwise in an upright position, thereby taking up less space.

Figure 5:
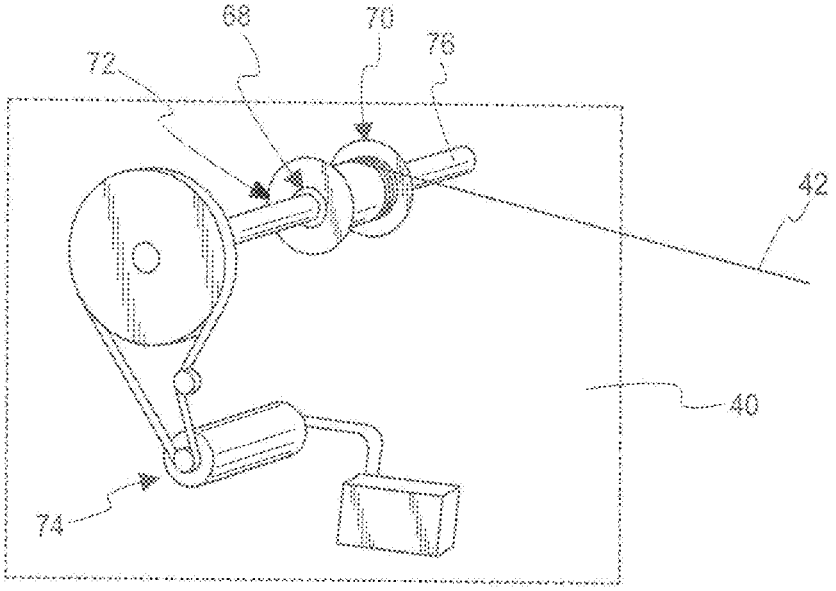
FIG. 5 is a perspective view of the component parts of a motorized tether exercise machine according to the principles of an embodiment of the present disclosure.

The component parts of the unit 40 will now be described in the embodiments of FIGS. 5 and 6. These component parts solve the problems associated with conventional machines. In particular, and turning first to FIG. 5, a one-way clutch 68 on the wound flexible element spool 70 along with a recoil mechanism 72. In one embodiment, the drive motor 74 is constantly driven at a speed while the payout spool 70 idles on the drive shaft 76. As soon as the user pulls with sufficient speed, the one-way clutch 68 locks onto the rotating shaft 76 and the user experiences resistance. The moment the user stops pulling, the recoil mechanism 72 begins to retract and the spool idles on the drive shaft. The recoiler 72 can be a wound spring or bungee cord. When it is desirous to allow for a long payout of the rope (flexible element) 42, for example longer than ten feet, the properties of the recoil system are such that the greater the distance of payout, the greater the tension produced by the recoil system.

Figure 6:
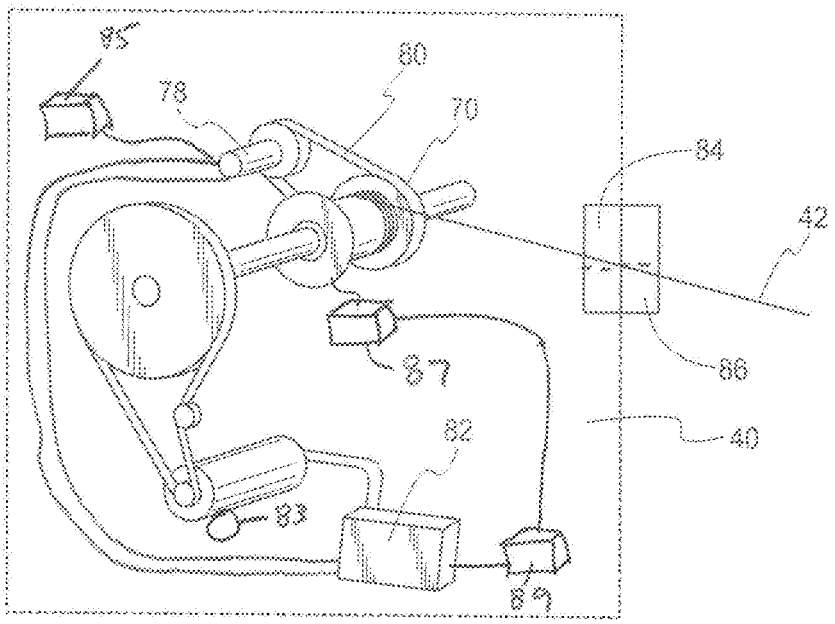
FIG. 6 is a perspective view of the component parts of the machine of FIG. 5 including a recoil device.

For example, and as shown in the embodiment of FIG. 6, a separate motor is used as a recoil device. This recoil motor 78 is directly coupled to the flexible element spool 70 via recoil motor drive belt 80 and is controlled by motor controller 82 such that it rotates the spool in the opposite direction of the drive motor. The recoil motor 78 can be continuously powered such that when the user is pulling on the flexible element 42, the recoil motor is forcibly rotated in a direction opposite from its driven direction. When the user releases pressure and returns the rope 42 toward the machine 40, the recoil motor 78 spins in its driven direction and rotates the flexible element spool 70 to collect the flexible element 42.

In one embodiment, in order to prolong recoil motor 78 life, a force sensing device 84 is used to detect force exerted on the flexible element. In this case, a minimum threshold is established, e.g. 5 lbs. When the force sensing device 84 senses less than the minimum threshold, the recoil motor 78 is activated. When the force sensing device 84 senses more than the minimum threshold, current to the recoil motor 78 is reduced via current controller (mechanism) 85. To further protect the recoil motor 78, a movement sensor 86 is provided which detects movement of the flexible element 42. When no movement is detected for a period of time, e.g. 30 seconds, current to the recoil motor 78 is reduced. The movement sensor 86 can also be used as a means for determining when the recoil motor 78 is activated. For example, if the flexible element is being pulled by the user, the movement sensor will detect this movement and current to the recoil motor can be reduced. When the user stops pulling and a stop in movement is detected, the recoil motor can again be activated.

Figure 7:
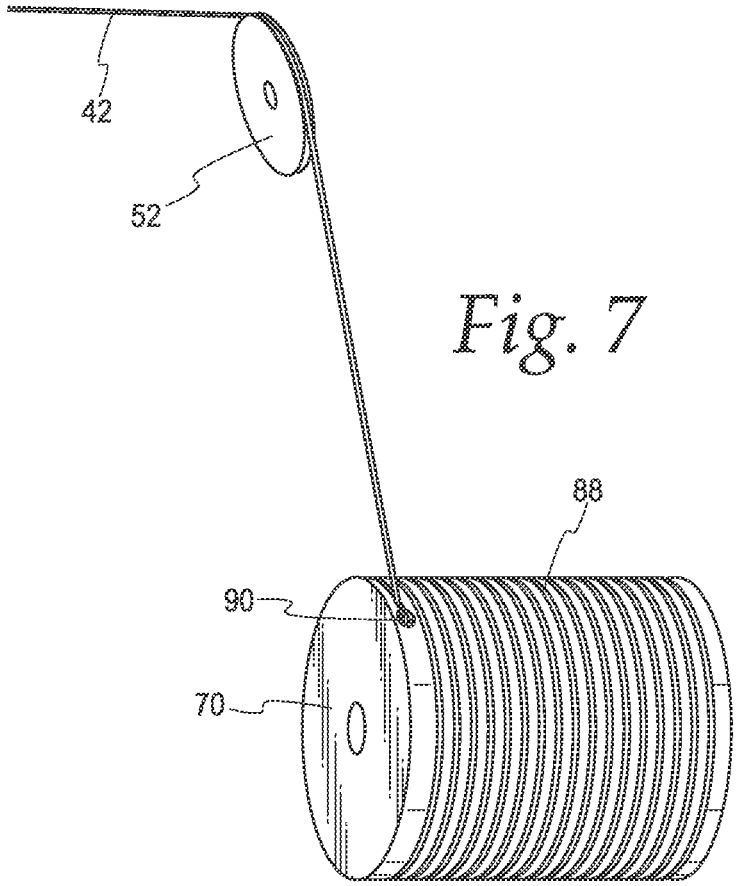
FIG. 7 is a perspective view of an alternate embodiment of the spool of the motorized body tether exercise machine of the present disclosure.

It will be appreciated that numerous conventional methods may be used to coil the rope 42 on the spool 70. FIG. 7 shows a method of combining a grooved barrel 88 on the spool 70 with a feeder pulley 52 mounted at an appropriate distance from the spool 70. The system uses a uniform rope for the flexible element, such as ¼" diameter Dyneema® or the like. A spiral groove is uniformly machined across the spool with a depth approximately equal to the diameter of the rope, with a groove to groove dimension also approximately equal to the diameter of the rope. A feeder pulley is mounted at a distance of approximately 160 times the diameter of the rope, for example, or greater from the surface of the spool and positioned to line up with a point perpendicular to the spool approximately 15 times the diameter of the rope, for example, away from the terminal end toward the center of the spool. The depth of the grooves will ensure that the rope lines up uniformly on the spool for the first row of wraps. The offset of the feeder pulley then allows subsequent wraps to line up in a manner such that three or more rows of rope will lay down on the spool without a tangle. In one embodiment, the start of the groove has a keyhole shaped cutout 90 machined into the spool with the narrow end approximately the width of the rope, and the larger end larger than the diameter of an overhand knot tied into the rope. This serves as a safety feature such that if the user is running against the machine and continues beyond the maximum length of the rope, the machine engageable end of the rope will release from the spool and avoid an abrupt stoppage of the user which could result in injury or damage to the machine.

An electronic system may be employed to prevent the user from damaging the machine, or injuring himself while attempting to run beyond the maximum length of the rope. In such an embodiment, a distance measuring device such as a rotary encoder mounted at the spool measures the distance of rope payout. The device is calibrated to recognize a maximum safe payout length, e.g. 10' less than the total length of rope. When the user reaches the maximum safe payout length, an audible alarm can be sounded to alert the user that a predetermined distance has been reached. Alternatively, the drive motor can be braked or changed in speed, or a tactile feedback device 89. As such, it can be activated to give the user tactile feedback indicating that a prescribed distance has been reached.

Typically, the drive motor will dissipate the energy expended by the user in the form of heat. In some applications, it is anticipated that a larger user may pull with a significant amount of force causing the motor to exceed its maximum rated temperature. One solution is to limit the amount of resistance provided by the machine. Since an athlete may provide short bursts of high force during a workout, it may be desirable to allow for greater amounts of resistance over short durations. In one embodiment, a temperature sensing device 83 such as a thermistor is mounted in close proximity to the drive motor. A circuit monitors the motor temperature such that in the event an overheat condition is detected, the circuit provides a calculated or predetermined current reduction to the motor which prevents overheating while still allowing the user to continue exercising at a lower resistance. Logic circuitry can also be used to prevent overheating. In particular, a force measuring device such as a motor current sensor or strain gauge is used in conjunction with a clock function to determine the average power dissipated by the motor. If average power exceeds a predetermined amount over a predetermined period of time, a current limit can be applied to the motor drive.

Figure 8:
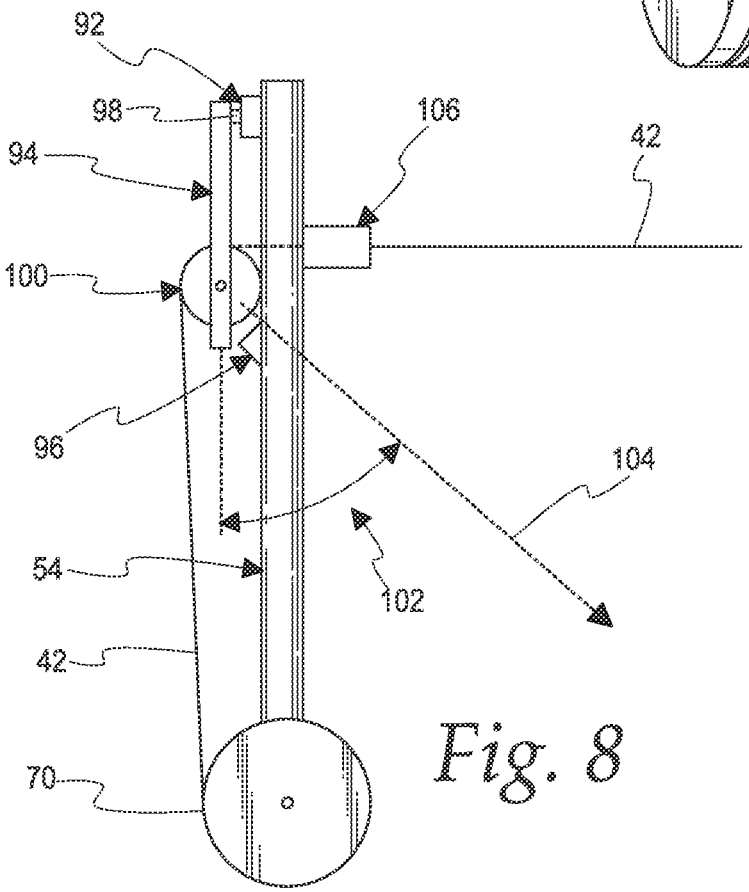
FIG. 8 is a side view of an alternate embodiment of the motorized tether exercise machine of the present disclosure utilizing a strain gauge.

In another embodiment shown in FIG. 8, a force measuring device 92, or sensor, such as a strain gauge or motor current sensing device is provided to measure and report exertion of the user. This mechanism may consist of a, strain gauge or the like, and when used in conjunction with the described distance measuring device and clock, information such as force, power, speed, distance, etc. can be provided. In order to obtain accurate force data without interfering with the smooth payout of the flexible element, unit 40 provides a novel exit pulley transfer linkage system which transfers a reduced force to the force measuring device. This allows for the use of a smaller, less expensive device, e.g. strain gauge. For example, a user may be capable of producing upwards of 300 lbs. of force which translates to almost 425 lbs. of force at the exit pulley. However, with the proper transfer linkage, e.g. 10:1, a smaller strain gauge, e.g. 50 lbs. max., can be used. A linkage 94 is provided which has a fulcrum point 96 at one end, a strain gauge contact point 98 at the other end, and a pulley 100 mounted at a point closer to the fulcrum end. The positioning of the pulley will determine the reduction ratio. Additionally, the angle 102 of the linkage relative to the resultant force on the flexible element will also affect the ratio and the resultant force 104 on the pulley.

Although the force measuring system as described works well for a user who walks/runs/pulls directly outward and straight away from the device, it nevertheless loses accuracy when the flexible element is pulled at an angle up/down or side to side. Accordingly, a fairlead system (as known) 106 positioned at a point directly perpendicularly to the exit pulley to provide a consistently normal angle from the exit pulley even if the user pulls at a non-normal angle. The fairlead can be a simple plastic (Delrin) piece, for example a Harken part no. 339, or a more substantial system using two sets of parallel rollers placed perpendicular with one another.

The current disclosure can provide valuable performance data as described above. This data can be displayed in real-time on the machine on a display device. However, there are many instances when the user is facing away from the machine and therefore unable to see the data. Accordingly, there is also provided a remote display option which is mounted at a point away from the machine near the terminal end of the flexible element. The display may contain numeric digits, graphical information, indicator lights, or the like. Communication with the display may be accomplished with wires, radio waves, blue-tooth, sonar, or other means known in the art. In addition to real-time data, the unit may be programmed to display current effort vs. a preset goal, such as the maximum power produced from a previous run. This visual display will act as a means for motivating the user to achieve various goals while exercising.

The foregoing detailed description has been given for clearness of understanding only and no unnecessary limitations should be understood therefrom. Accordingly, while one or more particular embodiments of the disclosure have been shown and described, it will be apparent to those skilled in the art that changes and modifications may be made therein without departing from the invention if its broader aspects, and, therefore, the aim in the appended claims is to cover all such changes and modifications as fall within the true spirit and scope of the present disclosure.

What is claimed is:

1. An exercise apparatus comprising:

a flexible element having a user engageable end;

a first motor and a second motor;

a flexible element spool mounted on a first motor driven driveshaft driven by the first motor for rotation of said spool in a first direction;

said spool includes a one-way clutch for engaging said driveshaft in said first direction;

a second motor driven recoiler driven by the second motor coupled to said spool for rotation of said spool in a second direction; and a current control for reducing current to said recoiler upon a force sensor sensing a force threshold.

2. An exercise apparatus comprising:

a flexible element having a user engageable end;

a first motor and a second motor;

a flexible element spool mounted on a first motor driven driveshaft driven by the first motor for rotation of said spool in a first direction;

said spool includes a one-way clutch for engaging said driveshaft in said first direction;

the second motor driven recoiler driven by the second motor coupled to said spool for rotation of said spool in a second direction; and a movement detector for detecting movement of said flexible element and a current control for reducing current to said recoiler upon detection of no movement.

3. The apparatus as defined in claim 1 or claim 2 further including a flexible element distance sensor coupled to said second motor for braking said motor upon measurement of a first distance threshold.

4. The apparatus as defined in claim 1 or claim 2 further including a flexible element distance sensor coupled to an audible alarm.

5. The apparatus as defined in claim 1 or claim 2 further including a flexible element distance sensor coupled to a tactile feedback.

6. The apparatus as defined in claim 1 or claim 2 further including a motor temperature sensor whereby said current control reduces current to said first motor upon said motor temperature sensor reaching a first threshold temperature.

* * * * *